US006945390B2

(12) United States Patent
Auclair

(10) Patent No.: US 6,945,390 B2
(45) Date of Patent: Sep. 20, 2005

(54) ARTICLE CARRIER WITH HANDLE-REINFORCING BRIDGING STRUCTURE

(75) Inventor: Jean Michel Auclair, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/253,770

(22) Filed: Sep. 24, 2002

(65) Prior Publication Data

US 2003/0094386 A1 May 22, 2003

Related U.S. Application Data

(63) Continuation of application No. PCT/US01/09383, filed on Mar. 28, 2001.

(30) Foreign Application Priority Data

Mar. 24, 2000 (GB) ..... 0007148
Aug. 10, 2000 (GB) ..... 0019589

(51) Int. Cl.[7] ..... B65D 75/00

(52) U.S. Cl. ..... 206/141; 206/140; 206/162; 206/163; 206/193; 206/199

(58) Field of Search ..... 206/141, 147, 206/162, 163, 165, 166, 168, 170, 175, 193, 194, 199, 200, 427, 428, 431, 434, 784, 140, 176, 177, 196; 229/117.09, 117.14, 198.1

(56) References Cited

U.S. PATENT DOCUMENTS 3,860,281 A * 1/1975 Wood ..... 206/175
5,158,177 A 10/1992 Negelen et al.
5,167,325 A 12/1992 Sykora
5,273,156 A 12/1993 Harris
5,595,291 A 1/1997 Negelen
5,975,287 A 11/1999 Negelen
6,155,412 A 12/2000 Le Bras et al.
2003/0111362 A1 * 6/2003 Sutherland et al. ..... 206/162

FOREIGN PATENT DOCUMENTS

| | | | | |
|---|---|---|---|---|
| AU | 9342502 | | 12/1993 | |
| DE | 1 536 047 | | 12/1969 | |
| EP | 0 122 397 | A2 | 10/1984 | |
| EP | 122397 | A2 * | 10/1984 | ..... B65D/71/00 |
| EP | 171703 | A2 * | 2/1986 | ..... B65D/71/00 |
| EP | 0 630 825 | A2 | 12/1994 | |
| FR | 2 376 040 | | 7/1978 | |
| FR | 2 470 734 | | 6/1981 | |
| FR | 2 593 780 | | 8/1987 | |
| FR | 2 776 267 | | 9/1999 | |
| GB | 480138 | | 2/1938 | |
| WO | 97/29973 | A1 | 8/1997 | |
| WO | 98/31601 | A1 | 7/1998 | |

* cited by examiner

*Primary Examiner*—Mickey Yu
*Assistant Examiner*—J. Gregory Pickett
(74) *Attorney, Agent, or Firm*—Tsugihiko Suzuki

(57) ABSTRACT

An article carrier for carrying one or more necked articles, has a plurality of panels including a pair of laterally spaced top panels, a pair of handle panels extending upwardly from the top panels to form a carrying handle, and a bridging panel provided to span the space between the top panels. One of the handle panels is formed with a medial fold line to cause the handle to be moved from an upright position downwards and/or to one side to reduce the height of the carrier.

17 Claims, 12 Drawing Sheets

12
14
16
18
G
G
20
22
10
82
90
88
R
94
86
84
98

12
42
14
46
76
82
16
28
S
90
18
G
20
52
22

12
42
44
46
88
H
26/30
56
54
52
22

22
38
52
74
54
56
T
30
18

ARTICLE CARRIER WITH HANDLE-REINFORCING BRIDGING STRUCTURE

This is a continuation of international application No. PCT/US01/09383, filed Mar. 23, 2001, which is hereby incorporated by reference.

BACKGROUND OF THE INVENTION

The invention relates to an article carrier which is particularly useful, but not limited to, carrying bottles. More particularly, the invention relates to an article carrier with an improved bridging structure for the strengthening handle and a reinforcing handle panel.

Bracing structures for bracing handle structures in article carriers are well known. For example, GB 480 138 illustrates a wraparound carrier which shows a pair of tabs 12, 12' formed from the handle panels spanning the space between the top panels and connected to each other by mechanical engagement. Such arrangements were possible because the cartons were packed by hand. However, in automated packaging machines, lateral movement of the panels to cause mechanical engagement of tabs 12 and 12' is undesirable.

In order to strengthen the handle structure, it is desirable for handle panels to be in face contacting relationship. However, in those carriers where the handle panels are spaced or diverge away from their point of connection it causes the handle structure to be weaker.

Other examples of bracing structures are illustrated in EP 0 122 397 and U.S. Pat. No. 5,158,177, however these structures are required to be constructed in the bottling machines which is undesirable because it increases the complexity of the machinery and/or limits carton throughput.

A further problem associated with the prior art concerns the stacking of such carriers which can interfere with the handles and destroy their integrity.

SUMMARY OF THE INVENTION

The present invention and its preferred embodiments seek to overcome or attempt to mitigate the problems associated with the prior art.

One aspect of the invention provides an article carrier for carrying one or more necked articles, which article carrier comprises a plurality of panels for forming the article carrier including a pair of laterally spaced top panels, a pair of handle panels extending upwardly from the top panels to form a carrying handle and bridging means is provided to span the space between the top panels. The bridging means is a sheet member formed from a separate blank, the opposite ends of the sheet member being attached to the handle panels.

Preferably, the bridging means may extend between the lower edges of the handle panels.

By providing the sheet member, the handle can be reinforced by different material, or which is a different grade to the board forming the outer panels.

According to an optional feature of this aspect of the invention the sheet member may include a medial bridging panel and a pair of handle reinforcing panels hingedly connected to the medial bridging panel and attached to the inside surfaces of the handle panels. Preferably, each handle reinforcing panel may be formed with a hand aperture.

A second aspect of the invention provides an article carrier for carrying one or more necked articles, which article carrier comprises a plurality of panels for forming the article carrier including a pair of laterally spaced top panels, a pair of handle panels extending upwardly from the top panels to form a carrying handle and bridging means is provided to span the space between the top panels. The bridging means comprises a pair of tabs formed from the handle panels and secured together in overlapping relationship to span the space between the top panels. Preferably, the pair of tabs may be glued together in face contacting relationship.

Beneficially, the bridging means provides a structure in which the bottles are maintained in position due to improved rigidity of the handle structure when it is in use.

According to an optional feature of the second aspect of the invention, the tabs may be hingedly connected to a lower edge of hand apertures formed in the handle panels.

A third aspect of the invention provides an article carrier for carrying one or more necked articles comprising a plurality of panels for forming the article carrier including a pair of laterally spaced top panels, first and second handle panels extending upwardly from the top panels to form a carrying handle, and bridging means provided to span the space between the top panels. The bridging means includes a bridging panel hingedly connecting the handle panels and the bridging panel and/or the first handle panel being adapted to allow the carrying handle to be placed in a collapsed form. Preferably, the carrying handle may be collapsed to be folded flat on part of one of the spaced top panels.

The bridging panel may have a fold line extending longitudinally across itself to allow the carrying handle to be collapsed so that the handle panels are placed in face contacting relationship.

According to another optional feature of the third aspect of the invention the first handle panel may be provided with a medial fold line spaced from the hinged connection between the bridging means and the first handle panel by a distance approximately equal to half of the spacing distance between the spaced top panels. The first handle is folded about the medial fold line to cause the second handle panel to be placed in flat form with respect to the bridging means. Alternatively, the first and second handle panels may each be provided with a medial fold line spaced from the hinged connection between the bridging means and the respective first and handle panels, whereby the first and second handle panels can be folded about the medial fold line to cause the second handle panel to be placed in flat form with respect to one of the spaced top panels.

According to a still further optional feature of the third aspect of the invention the bridging panel may span the space between the top panels wherein the bridging panel comprises a pair of tabs formed from the handle panels and secured together in overlapping relationship to span the space between the top panels. Preferably, the pair of tabs may be glued together in face contacting relationship.

The tabs of the third aspect of the invention may be hingedly connected to a lower edge of hand apertures formed in the handle panels.

A fourth aspect of the invention provides an article carrier for carrying a plurality of necked articles comprising a plurality of panels for forming the article carrier including a pair of laterally spaced top panels, first and second handle panels extending upwardly from the spaced panels hingedly connected to form a carrying handle. The first handle panel is provided with means to cause the handle to be moved from an upright position downwards and/or to one side to reduce the height of the carrier. Preferably, the height reduction means may be provided by a first medial fold line extending longitudinally along across the first handle panel adapted to cause the adjacent panel parts to be folded inwardly towards each other to move the handle downwards and to one side of the upright position. More preferably, the height reduction means may be provided by a second medial fold line extending longitudinally along across the second handle panel adapted to cause the adjacent panel parts to be folded inwardly towards each other to move the handle downwards and to one side of the upright position.

According to an optional feature of the fourth aspect of the invention the first and second handle panels may be formed with registered third medial fold lines at the elevation between the first medial fold line and/or as the case may be the second medial fold line and the top of the handle.

According to another optional feature of any preceding aspect of the invention, the handle panels may be secured together.

According to another optional feature of any preceding aspect of the invention, the handle panels may be hingedly connected together along a common upper edge.

According to another optional feature there may further comprise article receiving and retaining means struck from side and base panels and including an article retaining flap, which article retaining flap is adapted to be folded inwardly of the base panel thereby to define an aperture for receiving a lower portion of the article wherein the article retaining flap abuts a portion to engage and retain the article. Preferably, there may further comprise a fold line extending across the article retaining flap such that the flap is folded to define adjacent flap portions adapted to abut the side and base of the article at two positions thereby to improve article retention.

A fifth aspect of the invention provides a blank for forming an article carrier for carrying one or more necked articles, which blank comprises a plurality of panels for forming the article carrier including a first top panel, a pair of handle panels and a second top panel hingedly connected together in series. The first and second top panels are laterally spaced in use and bridging means is provided to span the lateral spacing between the top panels wherein the bridging means is a sheet member formed from a separate blank. The opposite ends of the sheet member are adapted to be attached to the handle panels. Preferably, the sheet member may include a medial bridging panel and a pair of handle reinforcing panels hingedly connected to the medial bridging panel and capable of attaching to the inside surfaces of the handle panels. Optionally, each handle-reinforcing panel may be formed with a hand aperture.

A sixth aspect of the invention provides a blank for forming an article carrier for carrying one or more necked articles, which blank comprises a plurality of panels for forming the article carrier including a first top panel, a pair of handle panels and a second top panel hingedly connected together in series. The first and second top panels are laterally spaced in use, and bridging means is provided to span the lateral spacing between the top panels. The bridging means comprises a pair of tabs formed from the handle panels and adapted to be secured together in overlapping relationship to span the space between the top panels. Preferably, the tabs may be hingedly connected to a lower edge of hand apertures formed in the handle panels.

A seventh aspect of the invention provides a blank for forming an article carrier for carrying one or more necked articles comprising a plurality of panels for forming the article carrier including a first top panel, first and second handle panels and a second top panel hingedly connected together in series. Bridging means is provided to span the space between the top panels, the bridging means including a bridging panel hingedly connecting the handle panels and the bridging panel and/or the first handle panel is adapted to allow the carrying handle to be placed in a collapsed form. Preferably, the carrying handle may be collapsed to be folded flat on part of one of the spaced top panels.

According to an optional feature of the seventh aspect of the invention, the bridging panel may have a fold line extending longitudinally across itself to allow the carrying handle to be collapsed so that the handle panels are placed in face contacting relationship.

According to another optional feature of the seventh aspect of the invention the first handle panel may be provided with a medial fold line spaced from the hinged connection between the bridging means and the first handle panel by a distance approximately equal to half of the spacing distance between the spaced top panels. The first handle is folded about the medial fold line to cause the second handle panel to be placed in flat form with respect to the bridging means.

According to a further optional feature of the seventh aspect of the invention the first and second handle panel may each be provided with a medial fold line spaced from the hinged connection between the bridging means and the respective first and second handle panel, whereby the first and second handle panels are folded about the medial fold line to cause the second handle panel to be placed in flat form with respect to one of the top panels. Preferably, the bridging means may span the space between the top panels in a set up condition wherein the bridging means comprises a pair of tabs formed from the handle panels. More preferably, the tabs may be hingedly connected to a lower edge of hand apertures formed in the handle panels.

An eighth aspect of the invention provides a blank for forming an article carrier for carrying a plurality of necked articles comprising a plurality of panels for forming the article carrier including a first top panel, first and second handle panels and a second top panel hingedly connected together in series. The first handle panel is provided with a first medial fold line extending longitudinally along across the first handle panel adapted to cause the adjacent panel parts to be folded inwardly towards each other in use to move the erected handle downwards and/or to one side of the upright position. Preferably, the height reduction means may be provided by a second medial fold line extending longitudinally along across the second handle panel adapted to cause the adjacent panel parts to be folded inwardly towards each other in use to move the handle downwards and to one side of the upright position.

According to an optional feature of the eighth aspect of the invention the height reduction means may be provided by a first medial fold line extending longitudinally along across the first handle panel and a second medial fold line extending longitudinally across the second handle panel adapted to cause the adjacent panel parts to be folded inwardly towards each other to move the handle downwards and to one side of the upright position.

According to an optional feature of the eighth aspect of the invention the first and second handle panels may be formed with registered third medial fold lines at the elevation between the first medial fold line and the top of the handle.

According to another optional feature of the eighth aspect of the invention, the handle panels may be secured together.

Preferably, the handle panels may be hingedly connected together along a common upper edge.

According to another optional feature, there may further comprise article receiving and retaining means struck from side and base panels and including an article-retaining flap. The article retaining flap is adapted to be folded inwardly of the base panel thereby to define an aperture for receiving a lower portion of the article in use wherein the article retaining flap can abut a portion to engage and retain the article. Preferably, there may further comprise a fold line extending across the article retaining flap such that the flap is folded to define adjacent flap portions adapted to abut the side and base of the article at two positions thereby to improve article retention when the carrier is in a set up condition.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
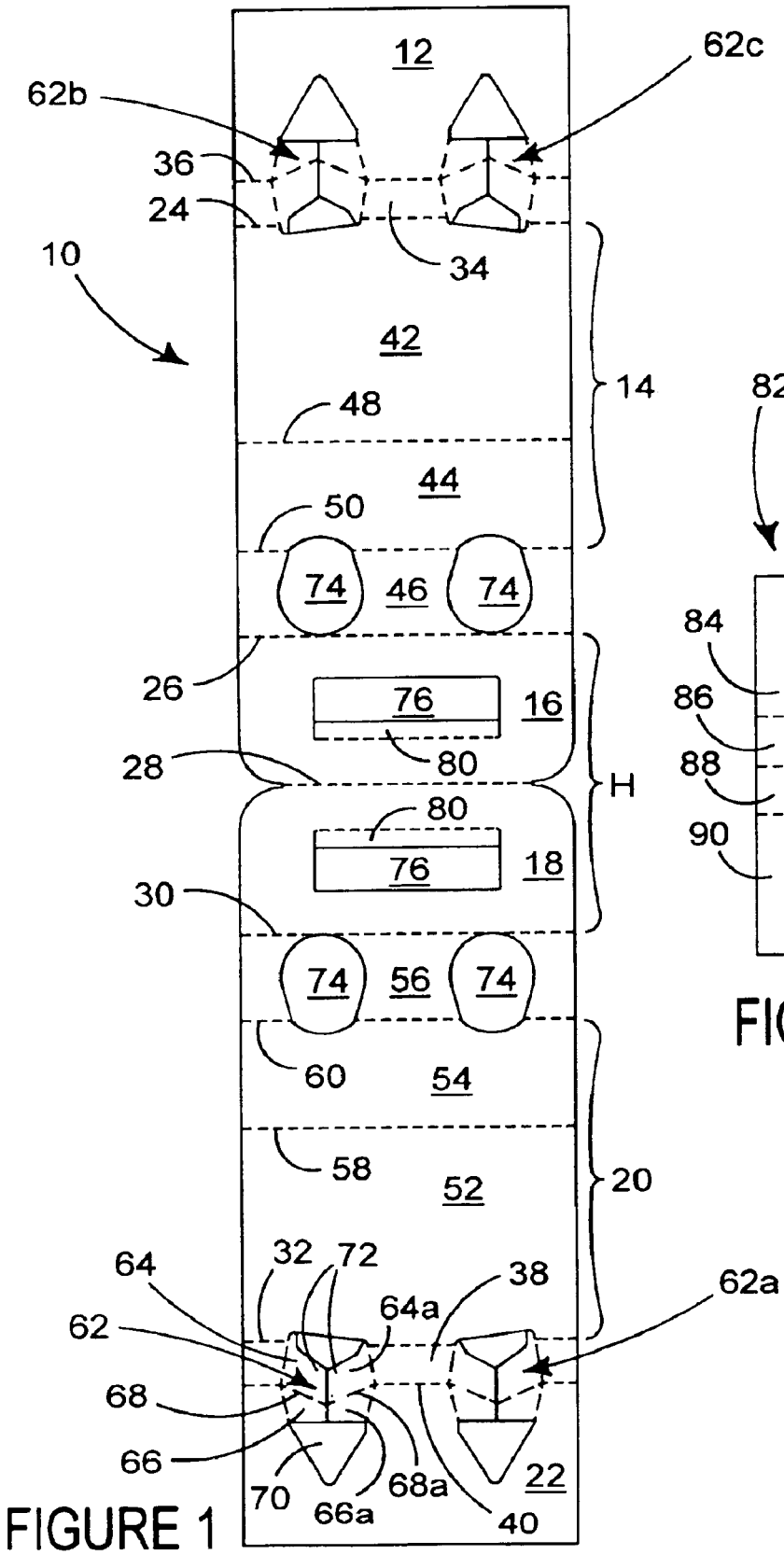
FIG. 1 is a plan view of a blank for forming a wraparound article carrier according to a first embodiment of the invention.
Figure 2:
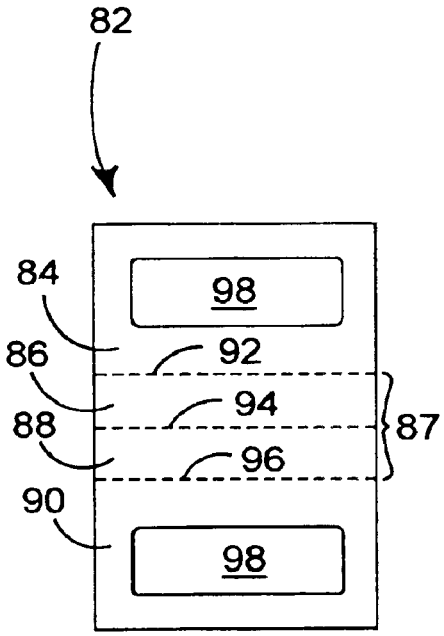
FIG. 2 is a plan view of a blank for forming the bridging means to be used with the blank shown in FIG. 1.

Referring to the drawings and, in particular, FIGS. 1 and 2 thereof, there is shown a two-part blank for forming an article carrier which blanks are formed from paperboard or other suitable foldable sheet material. The article carrier is adapted to accommodate a plurality of articles, for example four bottles arranged in two rows of two bottles each. It is envisaged the carrier can be adapted to accommodate a different number and/or configuration of articles according to user requirements.

Figure 4:
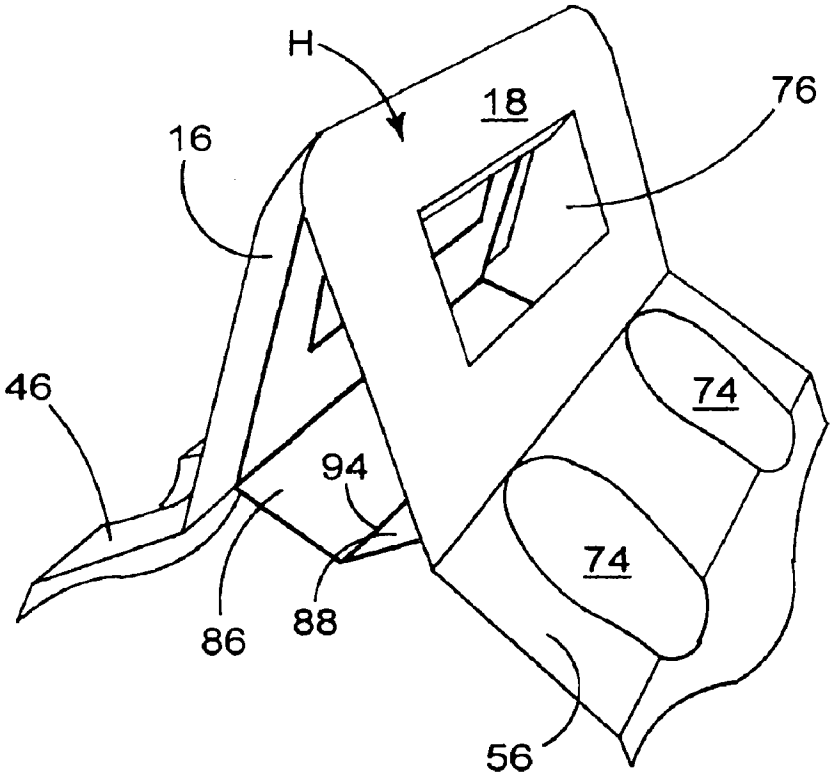
FIG. 4 is a perspective view of the handle structure of the article carrier formed from the blank shown in FIGS. 1 and 2.

The blank 10 comprises a plurality of panels for forming the top, sides and base of an article carrier. In this embodiment there comprises a first base panel 12, a side wall structure 14, a top panel 46, a handle structure H (FIGS. 1 and 4), a second top panel 56, a second side wall structure 20 and a second base panel 22 hingedly connected one to the next along fold lines 24, 50, 26, 30, 60 and 32 respectively. In the embodiment illustrated in FIG. 1, it will be seen that the base panel 12 may include an inclined heel (or slope) panel 34 intermediate base panel 12 and side wall structure 14 and hingedly connected thereto along fold lines 36 and 24 respectively. There may further comprise a second heel panel 38 intermediate side wall structure 20 and base panel 22 and hingedly connected thereto along fold lines 32 and 40 respectively.

Preferably, each side wall structure 14 and 20 comprise upper and lower side wall panels 44, 42 and 54, 52 respectively so that the side walls better conform to the shape of the articles contained. Each upper and lower side wall panel 44, 42 and 54, 52 is hingedly connected together along fold line 48 and 58 respectively to allow the side walls to flex, thereby to better conform to the shape of the articles contained in the article carrier.

There may further comprise article receiving and retaining means 62, 62*a*, 62*b* and 62*c* which are struck from the lower side wall panels 42, 52, base panels 12, 22 and, as the case may be, the intermediate heel panel 34, 38. Each article receiving and retaining means is identical and therefore only one of the article receiving and retaining means 62 is hereinafter described.

Figure 6:
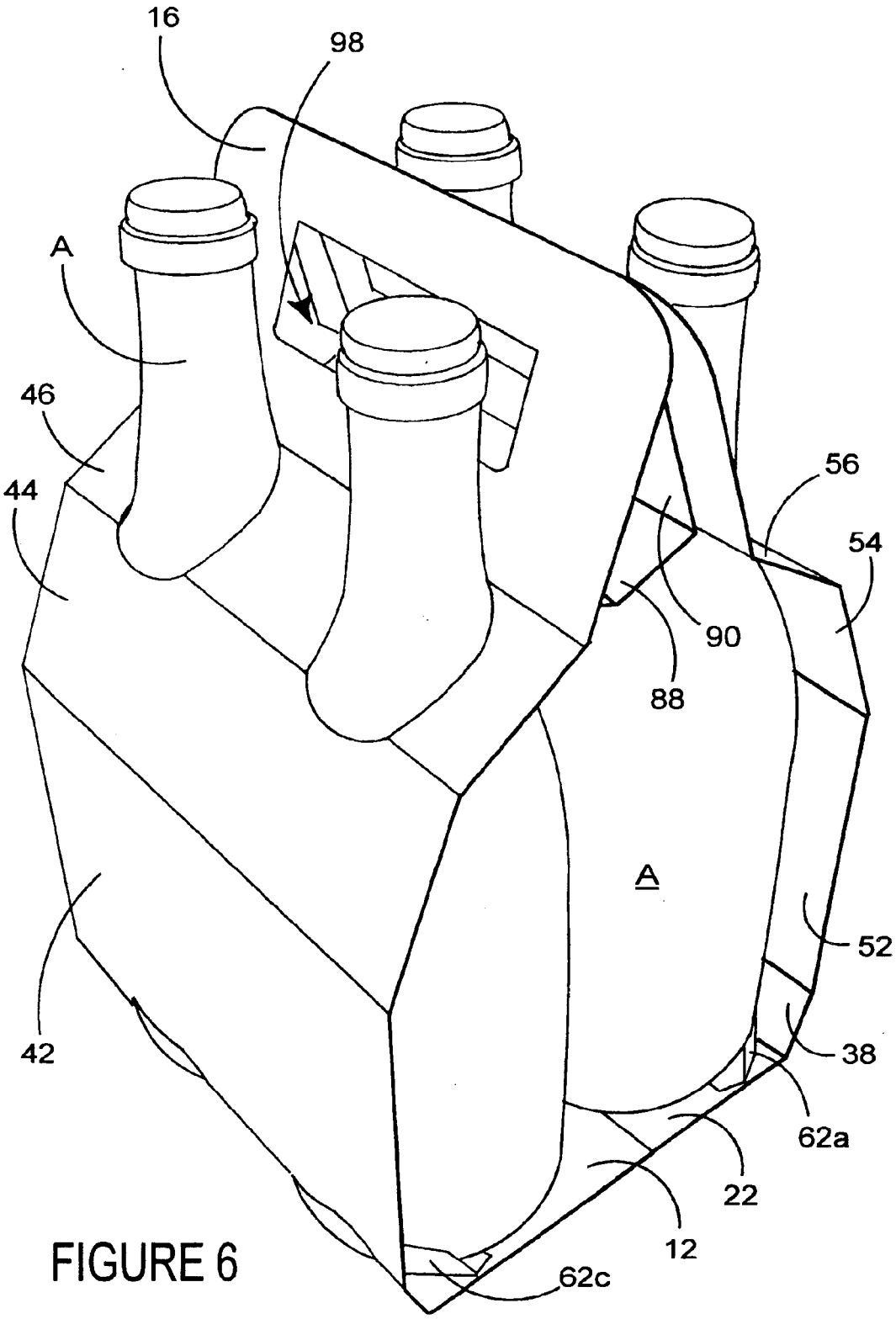
FIG. 6 is a perspective view of a package having a plurality of articles and the carrier formed from the blanks illustrated in FIGS. 1 and 2.

In this embodiment, the retaining means 62 comprises a retaining aperture 70 struck from the heel panel 38 and extending into base panel 22. It is shaped to receive a lower part of the article A, as shown in FIG. 6. The article receiving and retaining means 62 may further comprise one or more retaining flaps 72 which in a formed carton provide internal flap portions to retain the base of an article. More preferably, there comprises a pair of flaps 72 hingedly connected to the opposite edges of aperture 70. Each flap 72 comprises upper and lower flap portions 64, 66 hingedly connected together along fold lines 68 to enable the upper and lower flap portions to be folded out of alignment with respect to each other and to better conform to the shape of that part of the article A engaged by the flap 72 and in the aperture 70.

It will be seen that there may further comprise a plurality of apertures 74 formed in the top panel which are adapted to be aligned in vertically spaced registry with the corresponding article receiving and retaining means 62 in a set-up condition. These apertures 74 are provided to support a neck portion of the article and may, optionally, include a pair of substantially "V" shaped fold lines (not shown) struck from the upper side panels 44 and 54 to define fold lines to support tabs that protrude outwardly of the side wall structures 14, 20 in a similar manner to those illustrated in the second embodiment.

The handle structure H is provided with first and second handle panels 16, 18 hingedly connected together along their common lateral edge by fold line 28 to define the top of the handle. First handle panel 16 is secured to top panel 46 by fold line 26 and second handle panel 18 is secured to top panel 56 by fold line 30.

First and second handle panels 16, 18 are provided with hand apertures 76 and, optionally, hand support flaps 80 improve the handling characteristics of the article carrier.

FIG. 2 illustrates the bridging means 82 which, in this embodiment, is a sheet member formed from a separate blank. In other embodiments, the bridging means could be integral with and formed from the carrier blank 10. The opposite ends of the sheet member 82 are attached to the handle panels 16, 18 of the outer blank 10 as described in more detail below.

Preferably, the bridging means 82 comprises a first handle reinforcing panel 84, a medial bridging panel 87 and a second handle reinforcing panel 90 hingedly connected together one to the next along fold lines 92 and 96 respectively. Handle reinforcing panels 84, 90 may further comprise hand apertures 98 or recesses. Preferably, the medial bridging panel 87 comprises two panel parts 86 and 88 hingedly connected together along a common lateral edge by fold line 94. In use, fold line 94 allows the bridging panel 87 and handle structure H to be collapsed thereby enabling the article carrier to be supplied in a flat collapsed condition.

Turning to the construction of the article carrier of the present invention, it is envisaged that it can be formed by a series of sequential folding and gluing operations in a straight line machine so that the carrier is not required to be rotated or inverted to complete its construction. The folding process is not limited to that described below and may be altered according to particular manufacturing requirements.

FIGS. 3A to 3F illustrate the handle forming process. The first step is for the bridging means 82 to be folded along fold line 94 in direction R whereby opposing handle reinforcing panels 84 and 90 and medial bridging panel parts 86 and 88 are folded into face contacting relationship with each other so that the bridging means 82 is in the position shown in FIG. 3B. In those embodiments with hand apertures 98, the apertures are aligned.

Thereafter, the bridging means 82 is secured to the handle panels 16, 18. In this embodiment, the handle reinforcing panels 84, 90 are secured to handle panels 16 and 18 respectively by glue or other suitable means known in the art. It will be seen from FIG. 3C that glue is applied to one or more parts of the handle panels 16 and 18 designated by the letter G and the bridging means 82 is placed on handle panel 16 such that handle reinforcing panel 84 is in face contacting relationship with panel 16 and hand apertures 98 and 76 are aligned as shown in FIG. 3D.

Figures 3A, 3B, 3C, 3D, 3E, 3F:
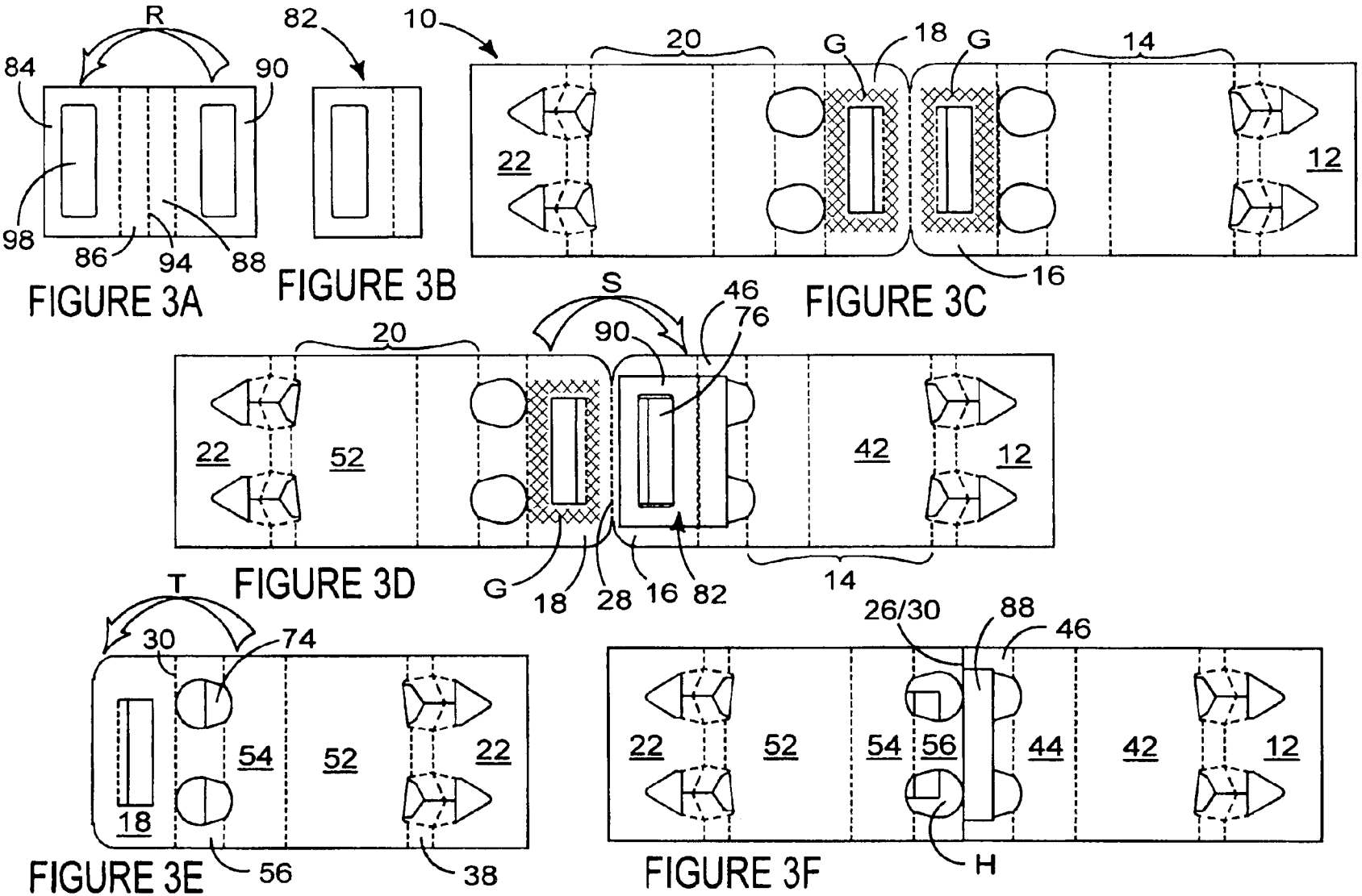
FIGS. 3A and 3B illustrate the formation of the bridging means shown in FIG. 2.
FIGS. 3C, 3D, 3E and 3F illustrate the formation of the handle structure incorporating the bridging means shown in FIG. 2 of the first embodiment.

The panels forming one side of the carrier comprising handle panel 18, top panel 56, side wall structure 20 and base panel 22 are then folded about central fold line 28 in direction S and handle reinforcing panel 90 is secured in face contacting relationship with handle panel 18 (see FIG. 3E). Thereafter, top panel 56, side wall structure 20 and base panel 22 are folded along fold line 30 in direction T so that top panel 56 is in face contacting relationship with handle panel 18 shown in FIG. 3F. The carrier is in a part-constructed condition with the handle structure H formed, but in a flat collapsed condition ready to be supplied to the end user.

In order to erect the article carrier, the top panels 46 and 56 are folded out of alignment with their next adjacent handle panels 16 and 18 respectively along fold lines 26 and 30 and are pulled in an outward direction away from each other to cause the medial bridging panel 87 to be erected and to span the space between the top panels 46, 56. It will be seen from FIG. 4 that panel parts 86 and 88 are folded out of face contacting relationship along fold line 94 and handle panels 16 and 18 are pulled apart so as to pivot about their common hinged connection 28 to form a tubular structure.

Figure 5:
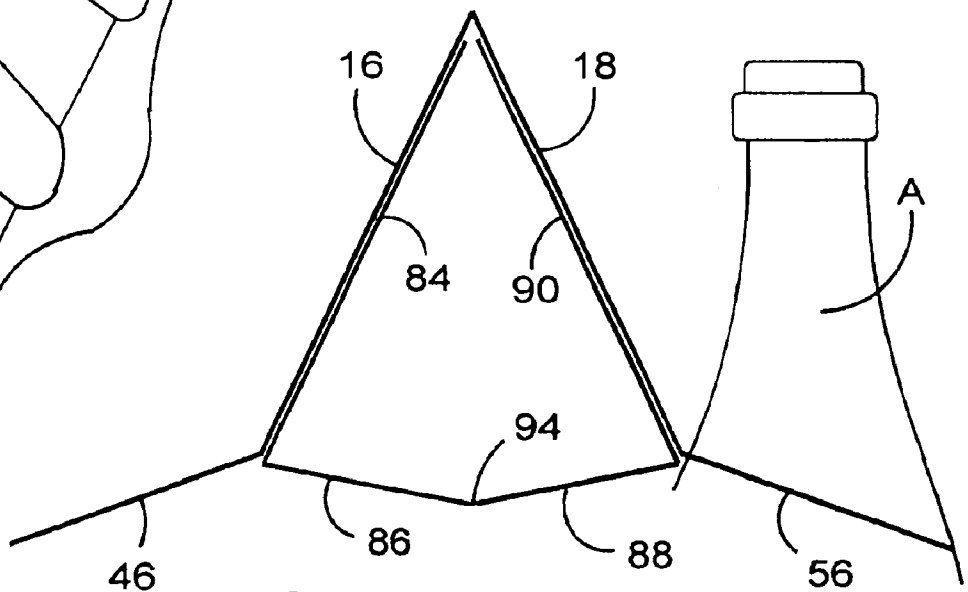
FIG. 5 is an end elevation of the handle structure shown in FIG. 4.

Thereafter, the top panels 46, 56 are applied to the tops of a group of articles to be packaged by the article carrier. The side wall structures 14 and 20 are folded downwardly and the upper and lower side wall panels 44, 42 and 54, 52 are folded out of alignment along fold line 48 and 58 so as to be disposed in flanking relationship with the side walls of the articles. The neck portion of the or each article A is engaged in the aperture 74 as shown in FIG. 5.

The heel retention flaps of the article heel retention means 62, 62*a* are then formed to receive a heel portion of the articles A as is well known. Base panel 22 and heel panel 38 are folded inwardly and upwardly into engagement with base portions of the articles. A similar operation on the other side of the group of articles is also performed and the wraparound carrier can be completed by securing the overlapping base panels 12, 22 together by suitable means known in the art, for example by gluing or, preferably, by the use of locking and retaining tabs.

Thus, the carrier is in a set up condition as shown in FIG. 6 whereby there is shown an article carrier 98 for carrying necked articles, comprising a plurality of panels for forming the article carrier including a pair of laterally spaced top panels 46, 56, a pair of handle panels 16, 18 extending upwardly from the top panels to form a carrying handle H and bridging means 82 provided to span the space between the top panels. The bridging means 82 is a sheet member formed from a separate blank, and the opposite ends of the sheet member are attached to the handle panels 16, 18.

In use, the user will insert his hand in the hand apertures 76 and fold the flaps 80 for improved cushioning during handling. As the carrier is moved, the handle panels are prevented from separation by the bridging means. Furthermore, each handle wall is two ply and is therefore strengthened to avoid any unwanted tearing which is unsightly and can lead the user to question the strength characteristics of the carrier.

Turning to the second embodiment of the invention illustrated by reference to FIGS. 7, 8, 9, 10, 11 and 12, there is shown a carrier that is similar to the article carrier of the first embodiment illustrated in FIGS. 1 to 6 and therefore like reference numerals have been used with the prefix "1".

Figure 7:
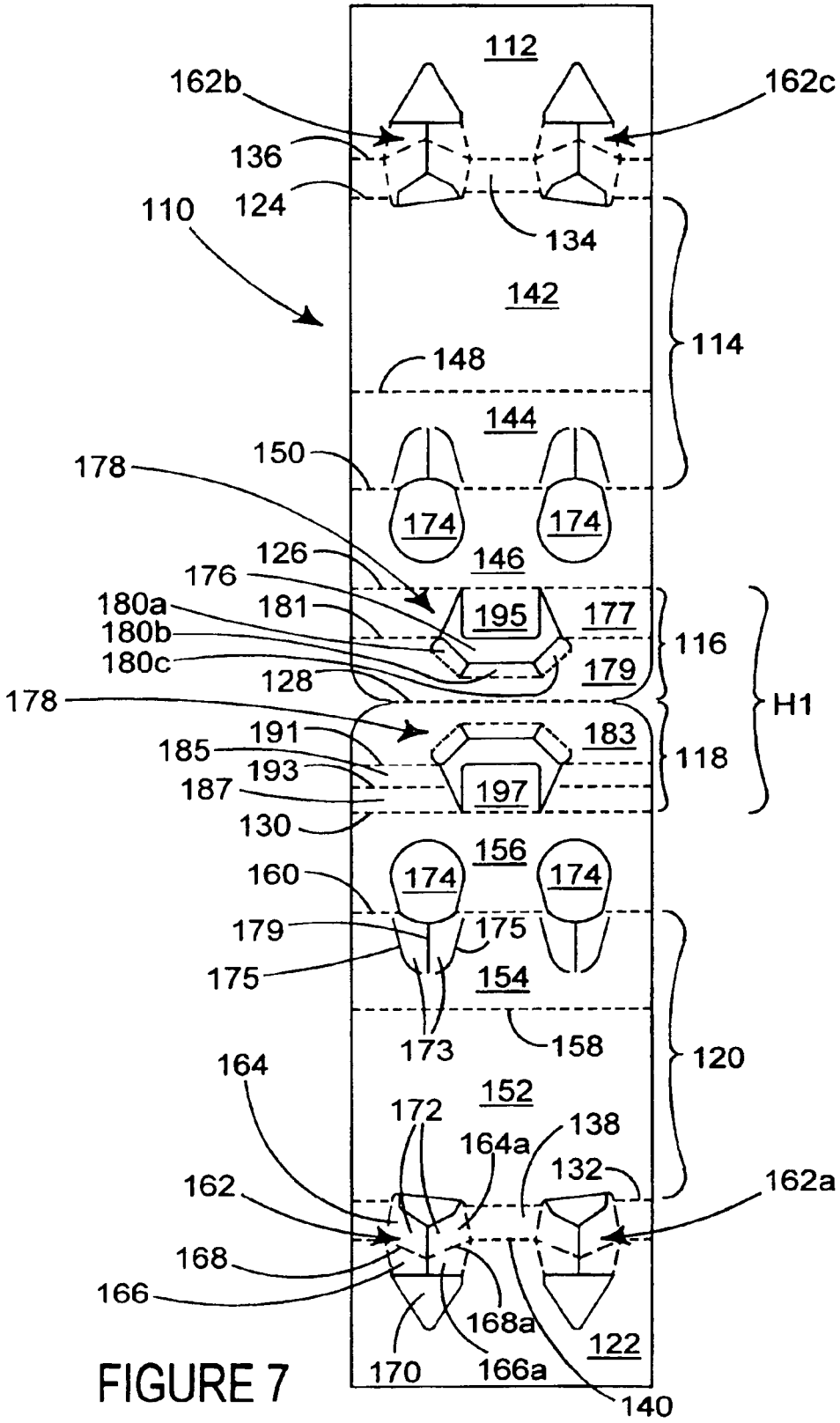
FIG. 7 is a plan view of a blank for forming a wraparound article carrier according to a second embodiment of the invention.

In FIG. 7 there is shown a unitary blank 110 made from paperboard or like foldable sheet material. The blank 110 comprises a first base panel 112, a side wall structure 114, a top panel 146, a handle structure H1 (FIGS. 7 and 9), a second top wall panel 156, a second side wall structure 120 and a second base panel 122 hingedly connected one to the next along fold lines 124, 150, 126, 130, 160 and 132 respectively. In the embodiment illustrated in FIG. 1, it will be seen that the base panel 112 may include an inclined heel (or slope) panel 134 intermediate base panel 112 and side wall structure 114 and hingedly connected thereto along fold lines 136 and 124 respectively. There may further comprise a second heel panel 138 intermediate side wall structure 120 and base panel 122 and hingedly connected thereto along fold lines 132 and 140 respectively.

Like the first embodiment, the first and second side wall structures 114 and 120 preferably comprise upper and lower side wall panels 144, 142 and 154, 152 hingedly connected together along fold line 148 and 158 respectively.

In one class of embodiments, there may further comprise article receiving and retaining means 162, 162*a*, 162*b* and 162*c* are struck from the lower side wall panels, base panels and the intermediate heel panels. Each article receiving and retaining means is identical to the article receiving and retaining means 62 of the first embodiment and is not therefore described in any greater detail.

A plurality of apertures 174 formed in the top panel which are adapted to be aligned in vertically spaced registry with the article receiving and retaining means 162 in a set-up condition. These apertures 174 are provided to support a neck portion of the article and may optionally include a pair of substantially "V" shaped fold lines 175 struck from the upper side panels 144 and 154 to define fold lines to support tabs 173 separated by cut line 179 that protrude outwardly of the side wall structures 114, 120.

The handle structure H is provided with first and second handle panels 116, 118 hingedly connected together along their common lateral edge by fold line 128. First handle panel 116 is secured to top panel 146 by fold line 126 and second handle panel 118 is secured to top panel 156 by fold line 130. First handle panel 116 comprises an upper handle panel 179 and a lower handle panel 177 hingedly connected together along interrupted fold line 181. Likewise, second handle panel 118 comprises upper handle panel 183 and lower handle panel 187 hingedly connected together along fold line 191. Alternatively, the second handle panel 118 may comprise an intermediate handle panel 185 hingedly connected to upper handle panel 183 along fold line 191 and to lower handle panel 187 along interrupted fold line 193. In use, fold line 193 can be used to assist in folding the handle structure into a flat collapsed condition for storage. A second, or alternative, function of the fold line 193 and intermediate panel 185 and lower handle panel 187 is to reduce the vertical height of the erected handle structure which is described in more detail below.

First and second handle panels 116 and 118 are provided with hand apertures 176 and, optionally, hand support flaps 180*a*, 180*b*, 180*c* improve the handling characteristics of the article carrier.

Bridging means 178 are provided, which in this embodiment is formed by a pair of tabs 195, 197 struck from and extending into hand aperture 176. Tab 195 is hingedly connected to top panel 146 along fold line 126 and likewise tab 197 is hingedly connected to top panel 156 along fold line 130.

Figures 8A, 8B, 8C:
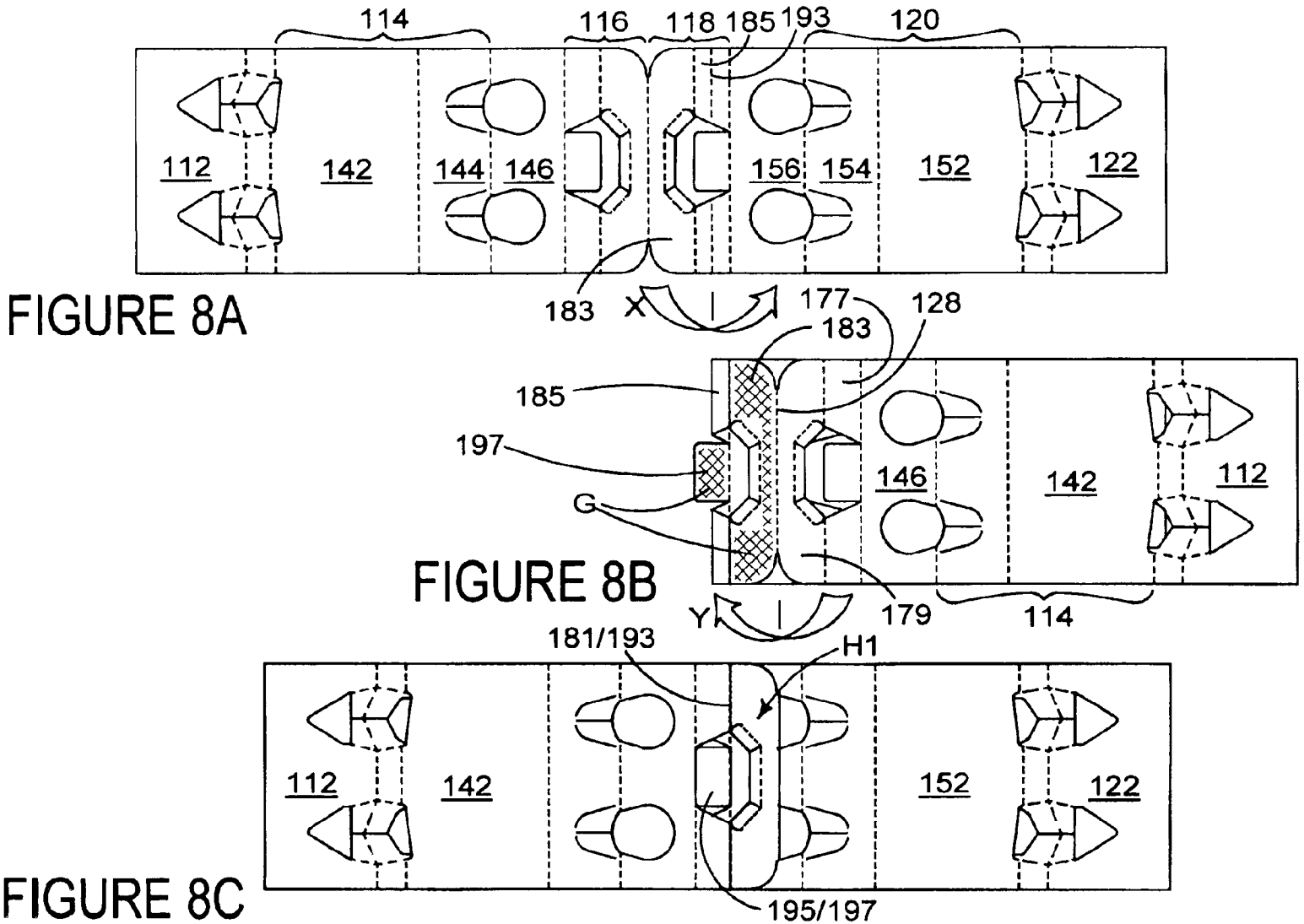
FIGS. 8A, 8B and 8C illustrate the formation of the handle structure incorporating the bridging means shown in FIG. 7 of the second embodiment.
Figure 9:
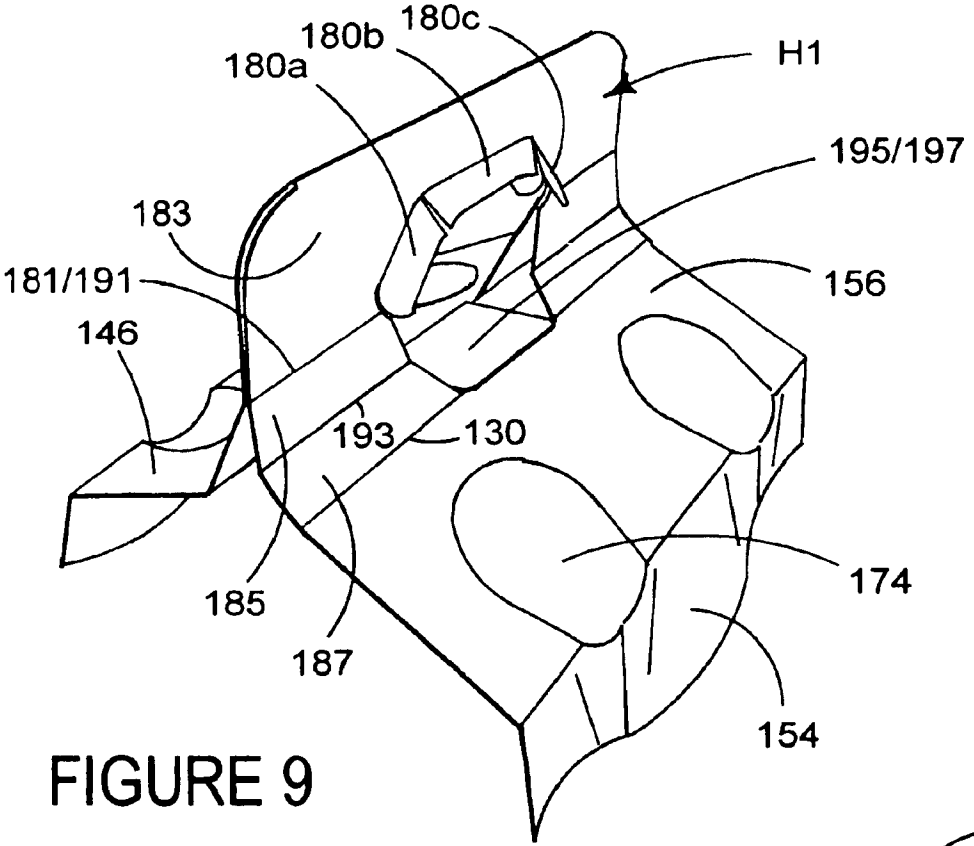
FIG. 9 is a perspective view of the handle structure of the article carrier formed from the blank shown in FIGS. 7, 8A, 8B and 8C.

The construction of the handle structure H1 of the second embodiment is illustrated in FIGS. 8A, 8B, 8C whereby the panels forming one side of the carrier comprising handle panel 116, top panel 146, side wall structure 114 and base panel 112 together with upper and intermediate handle panels 183 and 185 are folded about fold line 193 in the direction designated by the letter X (FIG. 8A), so that the aforementioned panels are placed in face contacting relationship with the panels forming the other side of the carrier as shown in FIG. 8B.

In this embodiment upper handle panels 179, 183 are secured together by glue or by other suitable means known in the art. The tabs 195, 197 forming the bridging means are also secured together. One way to achieve this, is for glue to be applied to those parts of tab 197 and upper handle panel 183. Those panels forming one side of the carrier 112, 114, 146 and 116 are folded about central fold line 128 in the direction designated by the letter Y (FIG. 8B) such that the tabs 195, 197 and upper handle panels 179 and 183 are secured together in face contacting arrangement as shown in FIG. 8C. Thus the handle H1 is in a flat collapsed condition and the blank 110 is ready to be supplied to a user for final erection and loading of the carrier.

In order to erect the article carrier of the second embodiment, the handle panel 116 and the upper and intermediate handle panels 183 and 185 are folded out of the plane of the top panels 146, 156 to make the top panels 146, 156 to be ready to receive a group of articles and are pulled upwardly to cause the handle structure H1 to be erected from a flat collapsed condition. The bridging panel formed from tabs 195, 197 spans the space between top panels 146 and 156. The lower and intermediate handle panels 177, 185 separate from each other and pivot about their common hinged connection 181/191 shown in FIGS. 9 and 10.

Figure 10:
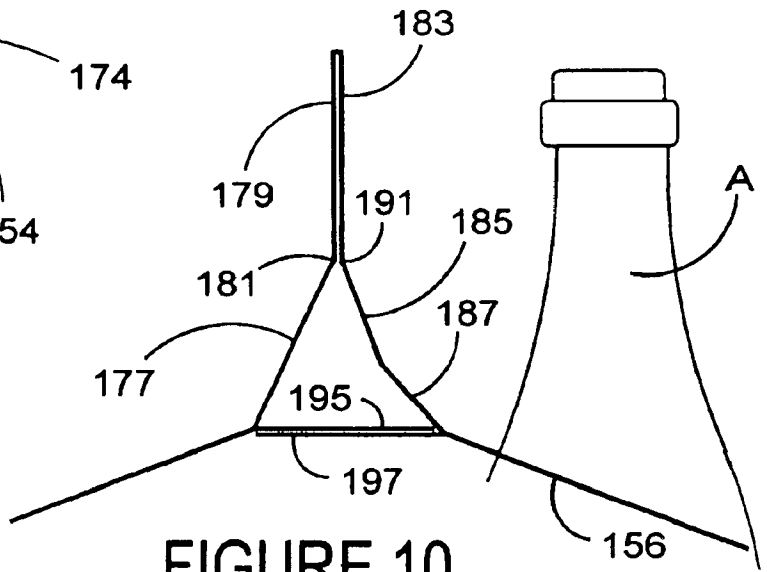
FIG. 10 is an end elevation of the handle structure shown in FIG. 9.
Figure 11:
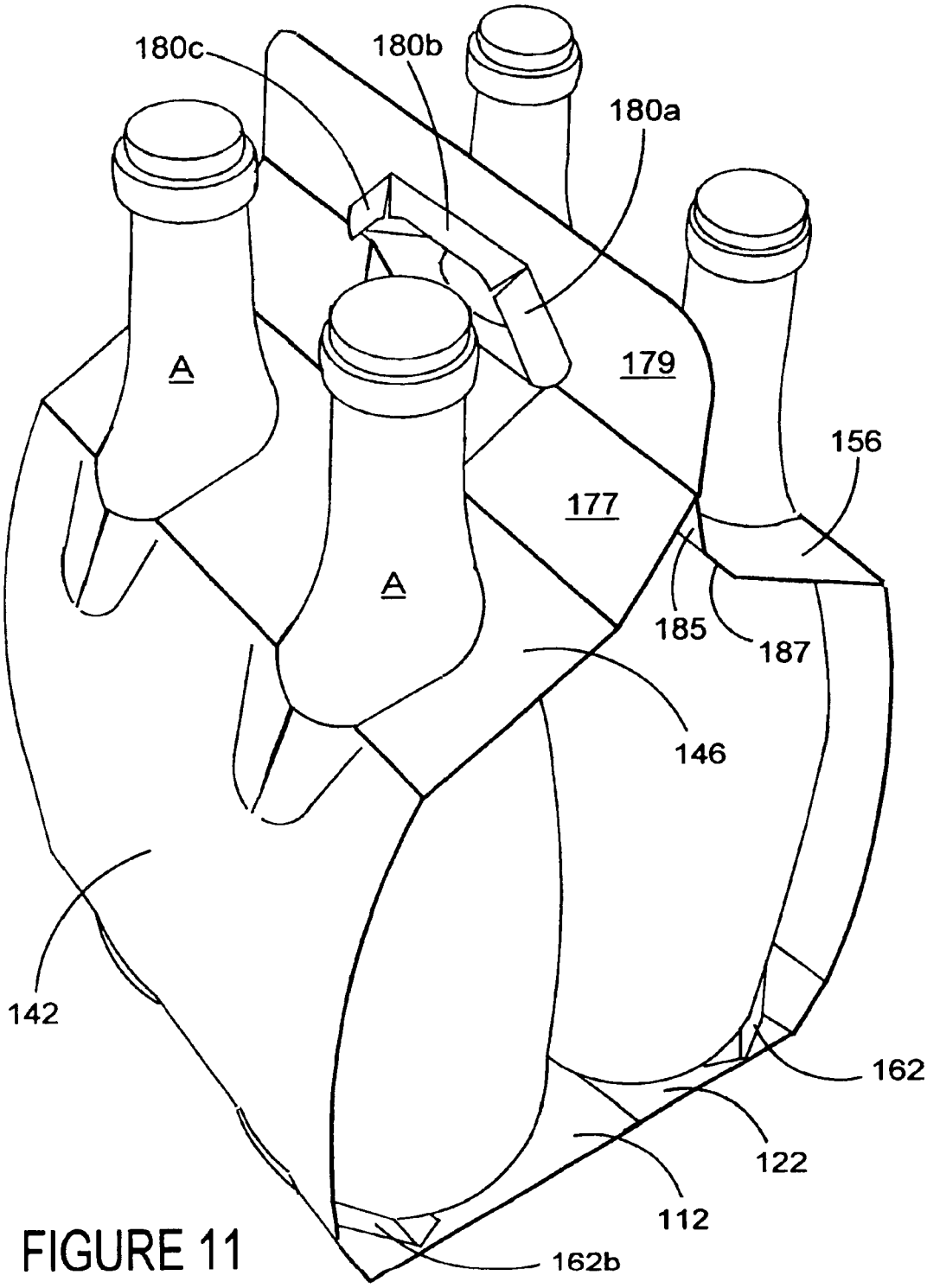
FIG. 11 is a perspective view of a package having a plurality of articles and an article carrier formed from the blank illustrated in FIG. 7.
Figure 12:
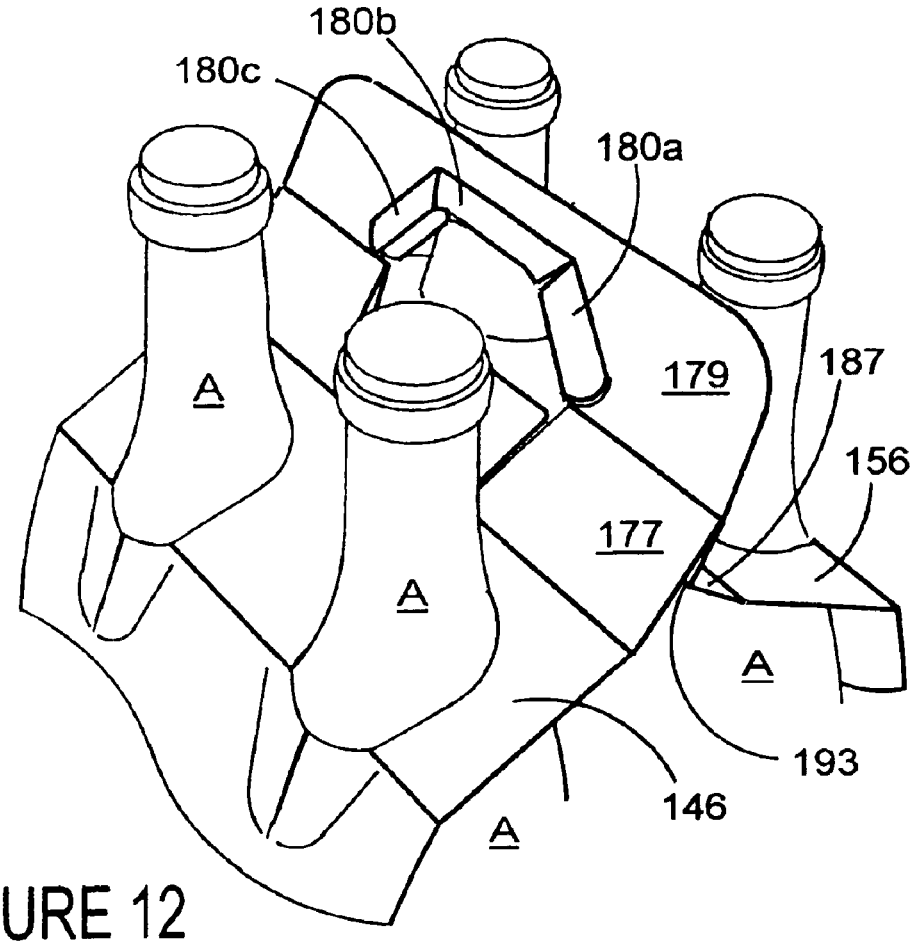
FIG. 12 is a perspective view showing the handle structure of article carrier in FIG. 11, showing the structure in a stowed position where the height reduction means is in use.
Figure 13:
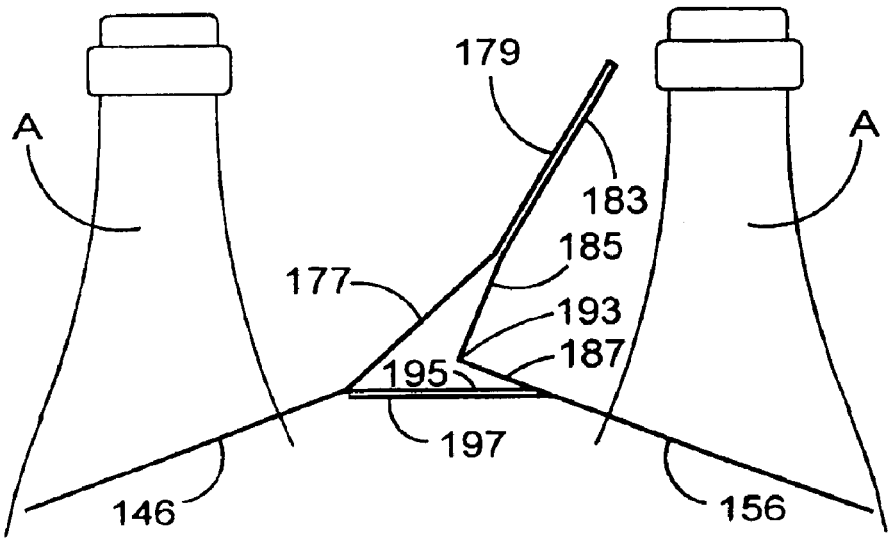
FIG. 13 is an end elevation of the handle structure shown in FIG. 12.

The top panels 146 and 156 are applied to the tops of a group of articles to be packaged by the article carrier, shown in FIG. 10, and the side walls are folded downwardly to be disposed in flanking relationship with the side wall structures 114, 120 of the articles so that a neck portion of each article A is engaged by the apertures 174. The heel retention means 162, 162*a*, 162*b*, 162*c* is formed as described above and the base wall is formed in like manner, the base panels are secured together to complete the construction of the article carrier as shown in FIG. 11.

Figure 14:
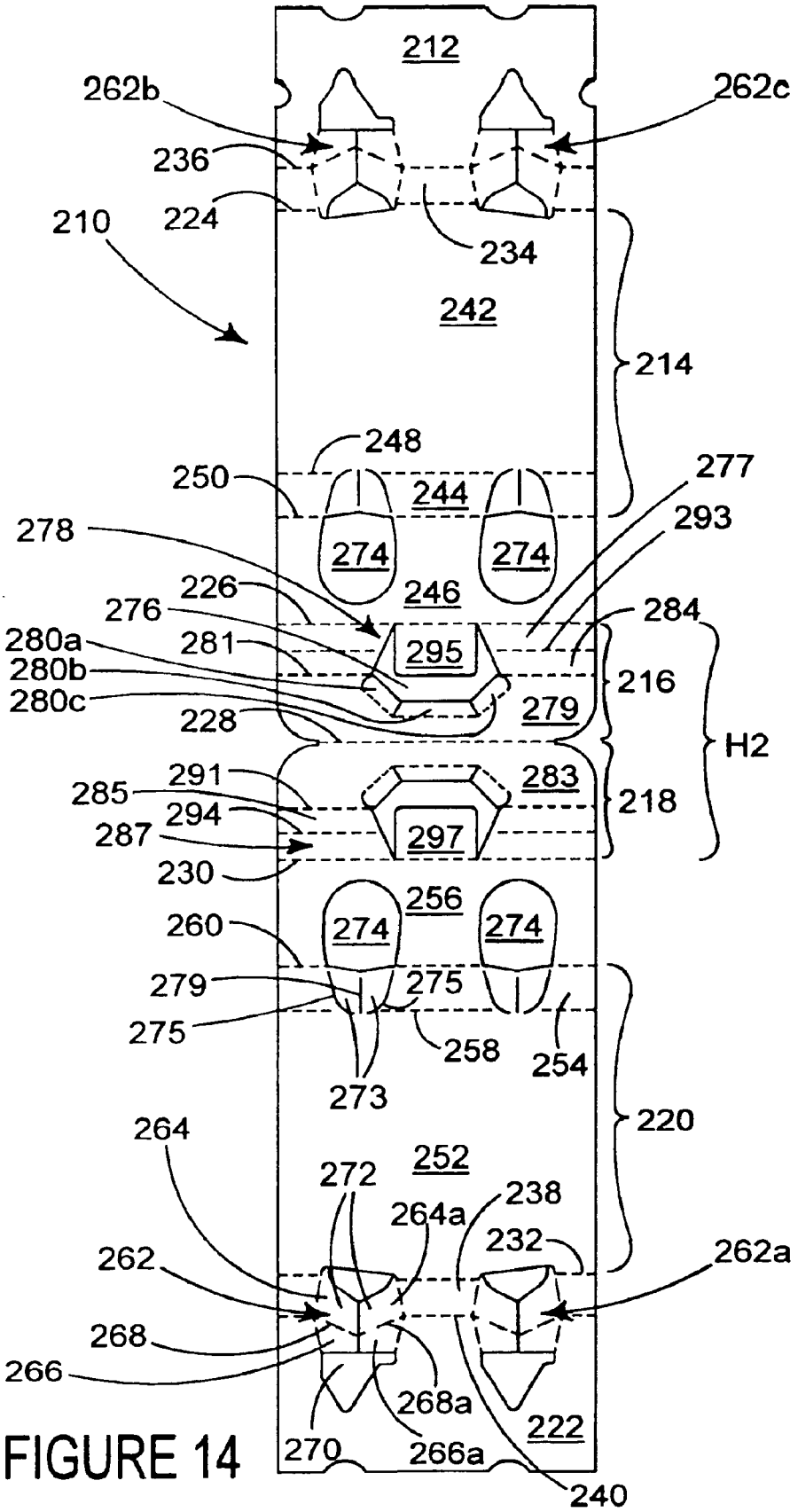
FIG. 14 is a plan view of a blank for forming a wraparound article carrier according to a third embodiment of the invention.

A third embodiment of article carrier is shown in FIGS. 14 and 15 in the form of a unitary blank which blank is formed from paperboard or other suitable foldable sheet material. The article carrier is adapted to accommodate a plurality of articles, for example four bottles arranged in two rows of two bottles each. It is envisaged the carrier can be adapted to accommodate a different number and/or configuration of articles according to user requirements.

The blank of the third embodiment is similar to the second embodiment with like parts being designated by the same numerals as the first and second embodiments but prefixed with the numeral "2" instead of "1". As the third embodiment is structurally similar to the second embodiment, only the differences will be described in any greater detail.

In one class of embodiments there may further comprise a pair of intermediate handle panels 284, 285 hingedly connected to upper handle panels 279, 283 along fold lines 281, 291 and to lower handle panel 277, 287 along interrupted fold line 293, 294. In use, fold lines 293, 294 can be used to assist in folding the handle structure into a flat collapsed condition for storage. A second, or alternative, function of the fold lines 293, 294, intermediate panels 284, 285 and lower handle panels 277, 287 is to reduce the vertical height of the erected handle structure H2 which is described in more detail below.

Figures 15A, 15B, 15C:
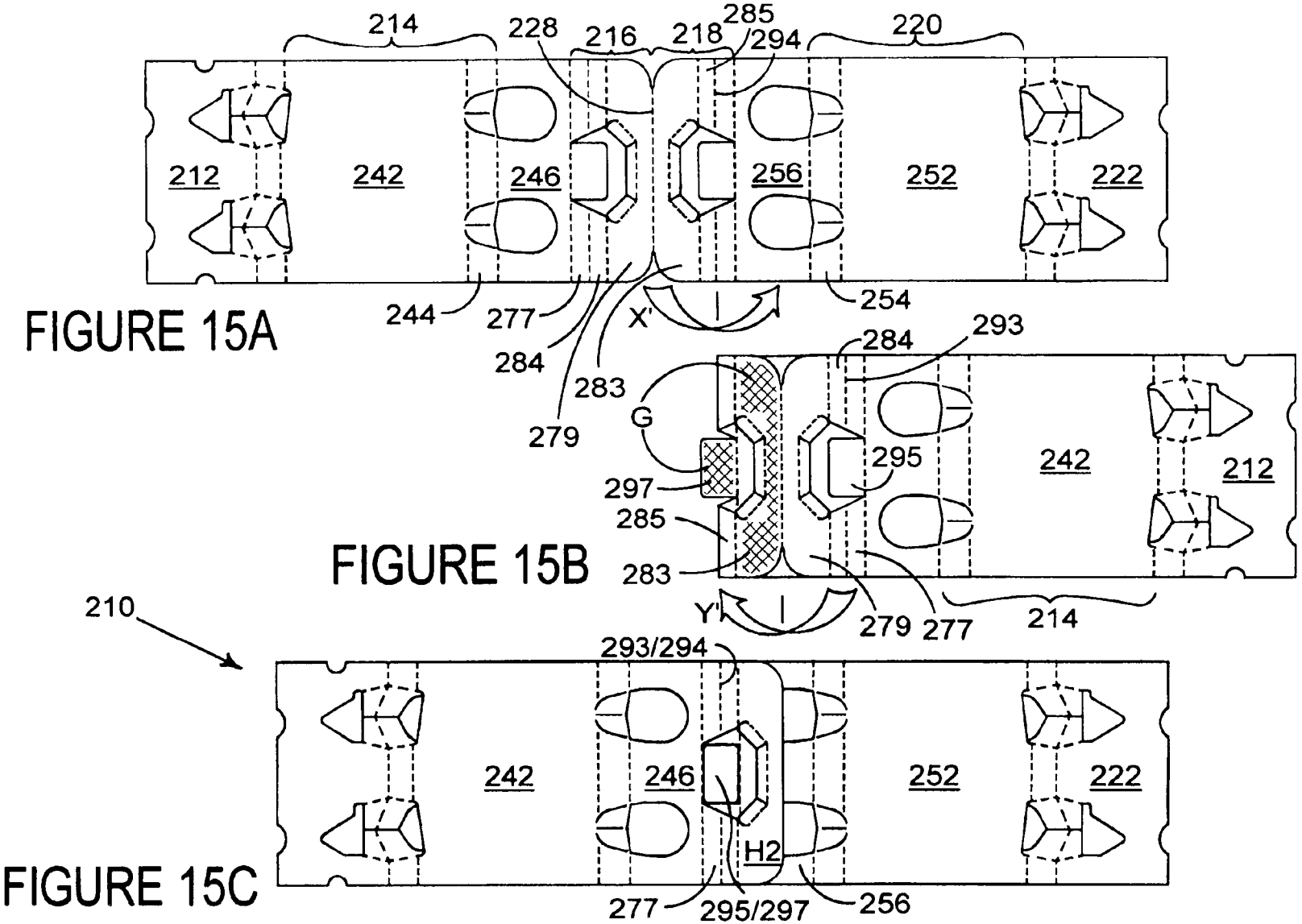
FIGS. 15A, 15B and 15C illustrate the formation of the handle structure incorporating the bridging means shown in FIG. 14.

The construction of the article carrier of the third embodiment is similar to the second embodiment, and the construction of the handle structure H2 of the third embodiment is illustrated in FIGS. 15A, 15B, 15C whereby the panels forming one side of the carrier comprising handle panel 216, top panel 246, side wall structure 214 and base panel 212 together with upper and intermediate handle panels 283 and 285 are folded about fold line 294 in the direction designated by the letter X' (FIG. 15A), so that the aforementioned panels are placed in face contacting relationship with the panels forming the other side of the carrier as shown in FIG. 15B.

In this embodiment upper handle panels 279, 283 are secured together by glue or by other suitable means known in the art. The tabs 295, 297 forming the bridging means are also secured together in like manner to the second embodiment whereby those panels forming one side of the carrier 212, 214, 246 and 216 are folded about central fold line 228 in the direction designated by the letter Y (FIG. 15B) such that the tabs 295, 297 and upper handle panels 279 and 283 are secured together in face contacting arrangement as shown in FIG. 15C. Thus, the handle structure H2 is in a flat collapsed condition and the blank 210 is ready to be supplied to a user for final erection and loading of the carrier. The medial fold lines 293, 294 ensure that the handle structure H2 can be folded forward or backward of the leading edge of the blank.

Figure 16:
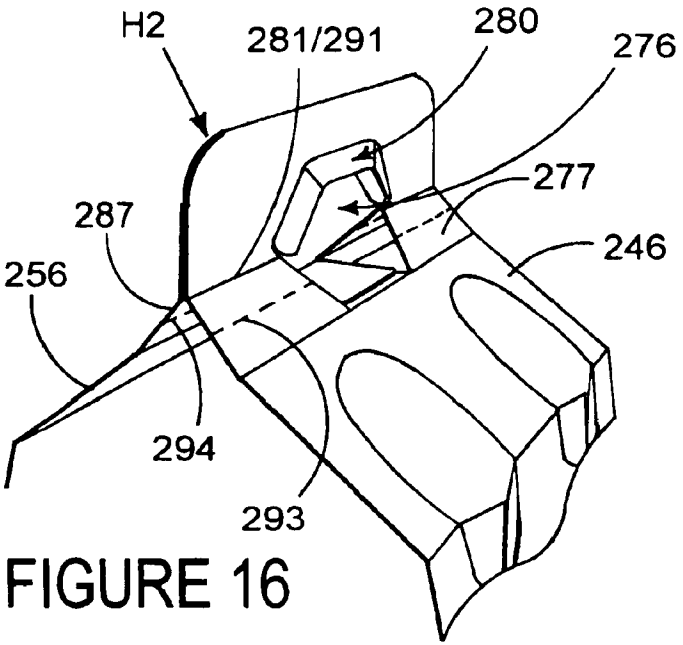
FIG. 16 is a perspective view of the handle structure of the article carrier formed from the blank shown in FIGS. 14, 15A, 15B and 15C.

In order to erect the article carrier, the handle panel 216 and the upper and intermediate handle panels 283, 285 are folded out of the plane of the top panels 246, 256 to make the top panels 246, 256 to be ready to receive a group of articles and are pulled upwardly to cause the handle structure H2 to be erected from a flat collapsed condition. The handle structure H1 in an erected condition is shown in FIG. 16 where the bridging panel formed from tabs 295, 297 spans the space between top panels 246 and 256. During the erection of the handle structure H2, the lower and intermediate handle panels 277, 284 separate from the intermediate handle panel 285 and pivot about their common hinged connection 281/291.

Figure 17:
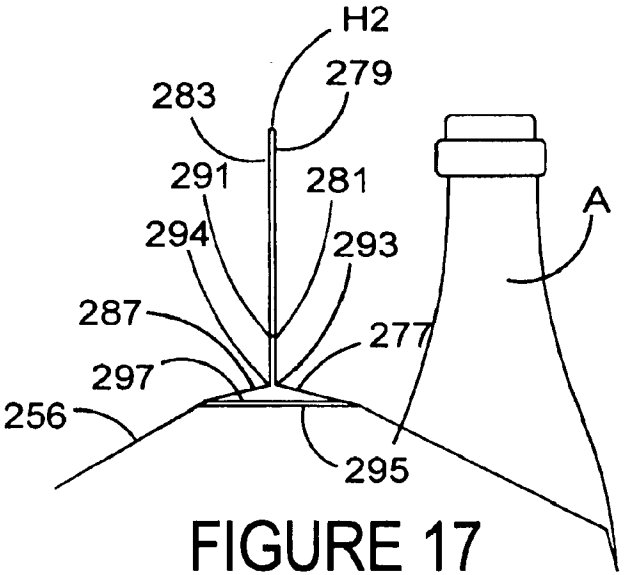
FIG. 17 is an end elevation of the handle structure of FIG. 16, showing the structure in a stowed position where the height of the structure has been reduced as a result of activating the height reduction means.
Figure 18:
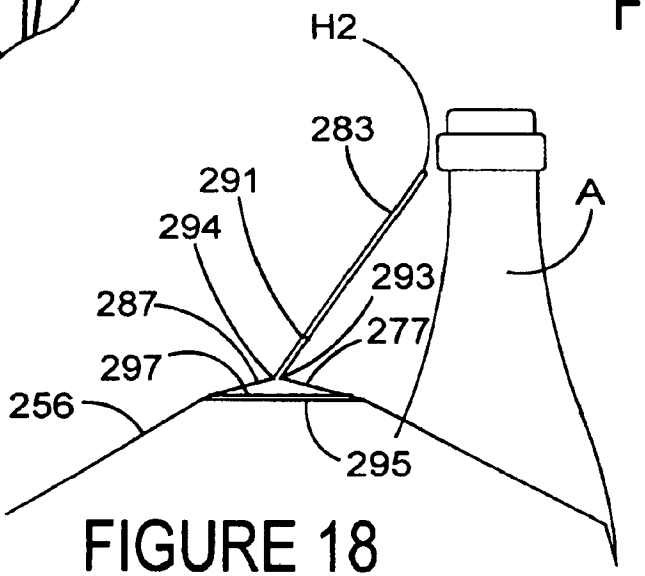
FIG. 18 is an end elevation of the handle structure of FIG. 16, showing the structure in an alternative stowed position where the height reduction means has been activated to fold the structure to one side.

The top panels 246 and 256 are applied to the tops of a group of articles to be packaged by the article carrier, shown in FIG. 17, and the side wall structures 214, 220 are folded downwardly to be disposed in flanking relationship with the side walls of the articles so that a neck portion of each article A is engaged by the apertures 274 shown in FIG. 17.

The heel retention flaps of the article heel retention means 262, 262*a*, 262*b*, 262*c* are then formed to receive a heel portion of the articles A as described above and the base wall is formed in a like manner. The base panels 212, 222 are secured together to complete construction of the article carrier.

Thus, it will be seen from FIGS. 11 and 16 the carrier of the second and third embodiments are in a set up condition whereby there is shown an article carrier for carrying one or more necked articles. The article carrier comprises a plurality of panels for forming the article carrier including a pair of laterally spaced top panels 146, 156; 246, 256, a pair of handle panels 116, 118; 216, 218 extending upwardly from the top panels to form a carrying handle. Bridging means 178, 278 is provided to span-the space between the top panels wherein the bridging means comprises a pair of tabs 195, 197; 295, 297 formed from the handle panels and secured together in overlapping relationship to span the space between the top panels.

In use, the user will insert his hand in the hand apertures 176; 276 and fold the flaps 180; 280 for improved cushioning during handling. As the carrier is moved the handle panels are prevented from separation by the bridging means. Furthermore, the upper handle wall is two ply and is therefore strengthened to avoid any unwanted tearing which is unsightly and leads the user to question the strength characteristics of the carrier.

In one class of embodiments, the handle structure H1 or H2 is at an elevation above the tops of the articles, shown in FIGS. 11 or 16 which allows easier access to the hand apertures 176, 276. However, if these packages are stored in a stacked condition then the handle structure H1, H2 may be damaged. To solve this problem, the handle structure H1, H2 is provided with means to cause the handle to be moved from an upright erected position downwards and/or to one side to reduce the height of the carrier. In the preferred embodiment, one or more of the handle panels 118; 216, 218 is provided with a medial fold line 193, 293, 294 that is adapted to collapse at least one side of the handle structure so as to lower the carrying handle H1, H2 into a stowed position as shown in FIGS. 12, 13, 17 and 18. It will be seen that the top of the handle is moved downwardly (FIGS. 17 and 18) and/or to one side (FIGS. 12, 13 and 18) so that the vertical height of the carrier is lower than the height of the bottle to be packaged.

One advantage of employing this approach is that the loaded carriers can be stored or shipped by stacking the carriers without destroying the integrity of the handle structure. It is intended that this aspect of the invention is not limited to article carriers described above. It is envisaged that the handle collapsing means can be applied to other carriers with a similar handle structure without the bridging means. Further, the other handle panel could also include a medial fold line to cause it to collapse downwardly by inwardly folding those panels either side of the medial fold line.

It will be recognized that as used herein, directional references such as "top", "base", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. A single article receiving structure may be provided in some embodiments, and in other embodiments a, linear array of additional apertures may be provided in each of the article receiving structures such that the carton may accommodate more than one article. Additional panel(s) may be provided between the main and transverse article receiving panels so as to form a curved interface therebetween.

What is claimed is:

1. An article carrier for carrying one or more necked articles, comprising a plurality of panels for forming the article carrier including a pair of first and second laterally spaced top panels, first and second handle panels extending upwardly from the first and second top panels respectively to form a carrying handle and bridging means provided to span a space between respective inner edges of the first and second top panels, wherein each of the first and second top panels is formed with at least one aperture for receiving a neck portion of a necked article, wherein the bridging means extends between the inner edges of the first and second top panels to span said space, and wherein the first handle panel comprises a medial fold line to allow the carrying handle to be placed in a collapsed form, the medial fold line being disposed such that the inner edge of the first top panel is interposed between the medial fold line and the at least one aperture in the first top panel, wherein the medial fold line is spaced from the inner edge of the first top panel by a distance generally equal to a half of the distance between said inner edges so as to allow the carrying handle to be folded flat on part of the first top panel.

2. An article carrier as claimed in claim 1 wherein the first handle panel is connected to the inner edge of the first top panel along a hinged connection so as to allow the first handle panel to be folded about the medial fold line to cause the carrying handle to be moved downward from an upright erected position to a tilted stowed position or to cause the second handle panel in flat form with respect to the bridging means.

3. An article carrier as claimed in claim 1 wherein the second handle panel is provided with a medial fold line such that the inner edge of the second top panel is interposed between the medial fold line of the second handle panel and the at least one aperture of the second top panel.

4. An article carrier for carrying one or more necked articles, comprising a plurality of panels for forming the article carrier including a pair of first and second laterally spaced top panels, first and second handle panels extending upwardly from the first and second top panels respectively to form a carrying handle and bridging means provided to span a space between respective inner edges of the first and second top panels, wherein each of the first and second top panels is formed with at least one aperture for receiving a neck portion of a necked article, wherein the bridging means extends between the inner edges of the first and second top panels to span said space, and wherein the first handle panel comprises a medial fold line to allow the carrying handle to be placed in a collapsed form, the medial fold line being disposed such that the inner edge of the first top panel is interposed between the medial fold line and the at least one aperture in the first top panel, wherein the second handle panel is provided with a medial fold line such that the inner edge of the second top panel is interposed between the medial fold line of the second handle panel and the at least one aperture of the second top panels, the medial fold line of the second handle panel is spaced from the inner edge of the second top panel by a distance generally equal to a half of the distance between said inner edges so that at least one of the first and second handle panels may be folded about a respective one of the medial fold lines to cause the carrying handle to be moved downward from an upright erected position to a tilted stowed position or to cause one of the first and second handle panels to be placed in flat form with respect to one of the first and second top panels.

5. An article carrier as claimed in claim 1 wherein the bridging means comprises a pair of tabs formed respectively from the first and second handle panels, said tabs extending respective from the inner edges of the first and second top panels and secured together in overlapping relationship to span said space.

6. An article carrier as claimed in claim 5 wherein the tabs are hingedly connected to the inner edges of the first and second top panels respectively.

7. An article carrier as claimed in claim 3 wherein the medial fold line in the first handle panel extends longitudinally across the first handle panel to cause adjacent panel parts of the first handle panel to be folded inwardly towards each other to move the carrying handle downwards.

8. An article carrier as claimed in claim 7 wherein the medial fold line in the second handle panel extends longitudinally across the second handle panel to cause adjacent panel parts of the second handle panel to be folded inwardly towards each other to move the carrying handle downwards.

9. An article carrier as claimed in claim 8 wherein the first and second handle panels are formed with registered third medial fold lines at an elevation between the first medial fold line and the top of the handle.

10. An article carrier as claimed in claim 9 wherein the first and second handle panels are secured together at respective portions thereof above the third fold lines.

11. An article carrier as claimed in claim 1 wherein the first and second handle panels are hingedly connected together along a common upper edge thereof.

12. An article carrier as claimed in claim 1 further comprising a pair of side panels, a base panel and article receiving and retaining means struck from the side and base panels to retain a lower portion of an article, the article receiving and retaining means including an article retaining flap folded inwardly of the base panel to define an aperture for receiving the lower portion of the article.

13. An article carrier for carrying one or more necked articles, comprising a plurality of panels for forming the article carrier including a pair of first and second laterally spaced top panels, a pair of handle panels extending upwardly from inner edges of the first and second top panels respectively to form a carrying handle and bridging means provided to span a space between the first and second top panels, wherein each of the first and second top panels is formed with at least one aperture for receiving a neck portion of a necked article, wherein the bridging means is a sheet member formed from a separate blank, the opposite ends of the sheet member being attached to inside surfaces of the first and second handle panels respectively such that the sheet member as whole is disposed between the aperture of the first top panel and the aperture of the second top panel.

14. An article carrier as claimed in claim 13 wherein the bridging means extends between the inner edges of the first and second top panels.

15. An article carrier as claimed in claim 13 wherein the sheet member includes a medial bridging panel and a pair of handle reinforcing panels hingedly connected to the medial bridging panel and attached to inside surfaces of the handle panels.

16. An article carrier as claimed in claim 15 wherein each of the handle reinforcing panels is formed with a hand aperture.

17. An article carrier as claimed in claim 15 wherein the medial bridging panel has a fold line extending longitudinally thereacross to allow the carrying handle to be collapsed so that the handle panels are placed in face contacting relationship.

* * * * *